US009765559B2

(12) United States Patent
Shin

(10) Patent No.: US 9,765,559 B2
(45) Date of Patent: Sep. 19, 2017

(54) MULTI-DIRECTIONAL ROTATIONAL SLIDING DOOR SELF-CLOSING DEVICE

(71) Applicant: Jung-Chul Shin, Incheon (KR)

(72) Inventor: Jung-Chul Shin, Incheon (KR)

( * ) Notice: Subject to any disclaimer, the term of this patent is extended or adjusted under 35 U.S.C. 154(b) by 0 days.

(21) Appl. No.: 15/403,397

(22) Filed: Jan. 11, 2017

(65) Prior Publication Data

US 2017/0198511 A1 Jul. 13, 2017

(30) Foreign Application Priority Data

Jan. 11, 2016 (KR) ..... 10-2016-0003177

(51) Int. Cl.

| | |
|---|---|
| ***E05F 5/00*** | (2017.01) |
| ***E05F 3/00*** | (2006.01) |
| ***E06B 3/46*** | (2006.01) |
| ***E05D 15/06*** | (2006.01) |

(52) U.S. Cl.

CPC ..... *E05F 5/003* (2013.01); *E05D 15/063* (2013.01); *E05F 3/00* (2013.01); *E06B 3/4636* (2013.01); *E05Y 2900/132* (2013.01); *Y10T 16/364* (2015.01)

(58) Field of Classification Search

CPC ..... E05Y 2900/132; E05Y 2201/684; E05Y 2201/614; E05Y 2201/64; E05Y 2201/688; E05D 15/063; E05D 15/0652; E05D 15/0665; E05D 15/0686; E05D 15/0691; E05D 15/0669; E05D 15/0621; Y10T 29/49778; Y10T 16/376; Y10T 16/359

USPC ..... 49/425

See application file for complete search history.

(56) References Cited

U.S. PATENT DOCUMENTS

| | | | | |
|---|---|---|---|---|
| 8,117,784 | B2 * | 2/2012 | Tarrega Illoret | E05D 15/063 16/106 |
| 8,127,494 | B2 * | 3/2012 | Kondash | E05F 15/684 49/197 |
| 8,402,606 | B1 * | 3/2013 | Tsai | E05F 3/18 16/49 |

(Continued)

FOREIGN PATENT DOCUMENTS

| | | | |
|---|---|---|---|
| KR | 10-1119924 | 2/2012 | E05C 17/06 |
| KR | 20-0474484 | 9/2014 | E05D 15/06 |
| KR | 10-1548488 | 8/2015 | E05F 1/08 |

*Primary Examiner* — Justin Rephann

(74) *Attorney, Agent, or Firm* — Harness, Dickey & Pierce, P.L.C.

(57) ABSTRACT

Disclosed is a multi-directional rotational sliding door self-closing device configured to automatically close a door moving along a rail straightly aligned with an extension rail. The self-closing device includes: a damper provided with a roller at its rear end and configured to move along the rail to automatically close the door and smoothen a closing speed; a roller assembly multi-directionally rotatably connected to a front end of the damper and configured to move along the rail; and a roller bracket connected to the roller assembly and fixed to an upper end of the door; and a coil spring inserted into an insertion hole provided in the roller assembly and configured to abut on a tip of the damper when the damper and the roller assembly are straightly aligned. The rail can be appropriately driven even when the rail is deformed. The damper and the roller assembly can be easily removed through a short space of the extension rail.

5 Claims, 11 Drawing Sheets

(56) References Cited

U.S. PATENT DOCUMENTS

| | | | | |
|---|---|---|---|---|
| 8,443,551 | B2 * | 5/2013 | Walhorn | E05F 1/16 16/71 |
| 9,388,622 | B1 * | 7/2016 | Paron | E05F 15/56 |
| 2011/0247275 | A1 * | 10/2011 | Coleman | E05F 15/605 49/358 |
| 2013/0160240 | A1 * | 6/2013 | Kenny | E05D 15/0626 16/89 |
| 2014/0090301 | A1 * | 4/2014 | Takahashi | E05D 15/063 49/360 |
| 2014/0310913 | A1 * | 10/2014 | Horwood | E05D 15/0669 16/100 |
| 2016/0138313 | A1 * | 5/2016 | Kreyenborg | E05D 15/0634 49/409 |
| 2016/0138314 | A1 * | 5/2016 | Kreyenborg | E05D 15/0643 49/420 |

* cited by examiner

MULTI-DIRECTIONAL ROTATIONAL SLIDING DOOR SELF-CLOSING DEVICE

CROSS REFERENCES TO RELATED APPLICATIONS

The present application claims benefit of and priority to Korean Patent Application No. 10-2016-0003177, filed in the Korean Patent Office on Jan. 11, 2016, the entire contents of which are incorporated herein by reference.

FIELD

The present disclosure relates to a sliding door self-closing device, and more particularly, to a multi-directional rotational sliding door self-closing device capable of allowing a sliding door to be appropriately driven even on a deformed rail and facilitating removal of the sliding door from the deformed rail.

BACKGROUND

In general, doors are classified into a hinged type and a sliding type depending on its open/close mechanism. In the case of the hinged type, a hinge structure is installed between a wall and a door to allow the door to be opened or closed as the door is pushed or pulled. In the case of the sliding type, a rail is installed above or below the door, and the door is opened or closed by sliding along the rail.

In the sliding type, an integrated module of a roller assembly and a damper also slides along the rail provided above the door. In this case, if the rail is significantly long and is deformed by an external force, it is difficult to appropriately drive the roller assembly and the damper designed to internally slide along the rail due to the deformed rail.

Typically, an extension rail is provided in straight alignment with the rail in order to allow a user to perform maintenance or inspection by removing the roller assembly and the damper from the rail. As described above, if the rail is deformed, it is difficult to remove the extension rail and then remove the roller assembly and the damper from the rail through the removed space.

Even if the roller assembly and the damper are designed to rotate in a certain direction as discussed in Korean Utility Registration Model No. 20-0474484, it is also difficult to appropriately drive the damper and the roller assembly along the deformed rail and remove them from the rail.

CITATION LIST

[Patent Literature 1] Korean Utility Model Application No. 20-2013-0001671 (Registration No. 20-0474484)

SUMMARY

In view of the aforementioned problems, the present disclosure provides a multi-directional rotational sliding door self-closing device by which the damper and the roller assembly can be appropriately driven on the rail even when the rail is deformed, and the damper and the roller assembly can be easily removed through a short space of the extension rail.

According to an aspect of the present invention, there is provided a self-closing device configured to automatically close a door moving along a rail straightly aligned with an extension rail, including: a damper provided with a roller at its rear end and configured to move along the rail to automatically close the door and smoothen a closing speed; a roller assembly multi-directionally rotatably connected to a front end of the damper and configured to move along the rail; a roller bracket connected to the roller assembly and fixed to an upper end of the door; and a coil spring inserted into an insertion hole provided in the roller assembly and configured to abut on a tip of the damper when the damper and the roller assembly are straightly aligned.

In the sliding door self-closing device described above, the roller assembly has a support protruding from its rear end and a ring connector formed at a tip of the support and provided with a through-hole, the damper has a connector receptacle cavity formed at its front end where the ring connector is inserted and is rotated in multiple directions, a fixing pin is provided to penetrate through a portion of the connector receptacle cavity of the damper and the through-hole of the ring connector, and the through-hole has a diameter decreasing and increasing from one side to the other side.

In the sliding door self-closing device described above, a lower side of the connector receptacle cavity may be opened, and the support may be inserted into the opened lower side of the connector receptacle cavity when the roller assembly is rotated downward with respect to the damper.

In the sliding door self-closing device described above, the damper may have a body, a block disposed at a front end of the body and provided with a connector receptacle cavity at its front end, a metal casing provided on an outer side surfaces of the body and the block 10 to fix the body and the block, and a roller provided at a rear end of the metal casing.

In the sliding door self-closing device described above, the block may have a first block provided with a first circular recess, and a second block assembled with the first block and provided with a second circular recess combined with the first circular recess to form the connector receptacle cavity.

BRIEF DESCRIPTION OF THE DRAWINGS

The foregoing and additional features and characteristics of this disclosure will become more apparent from the following detailed description considered with reference to the accompanying drawings, wherein.

DETAILED DESCRIPTION

A multi-directional rotational sliding door self-closing device according to preferred embodiments of the present invention will now be described with reference to the accompanying drawings.

Figure 1:
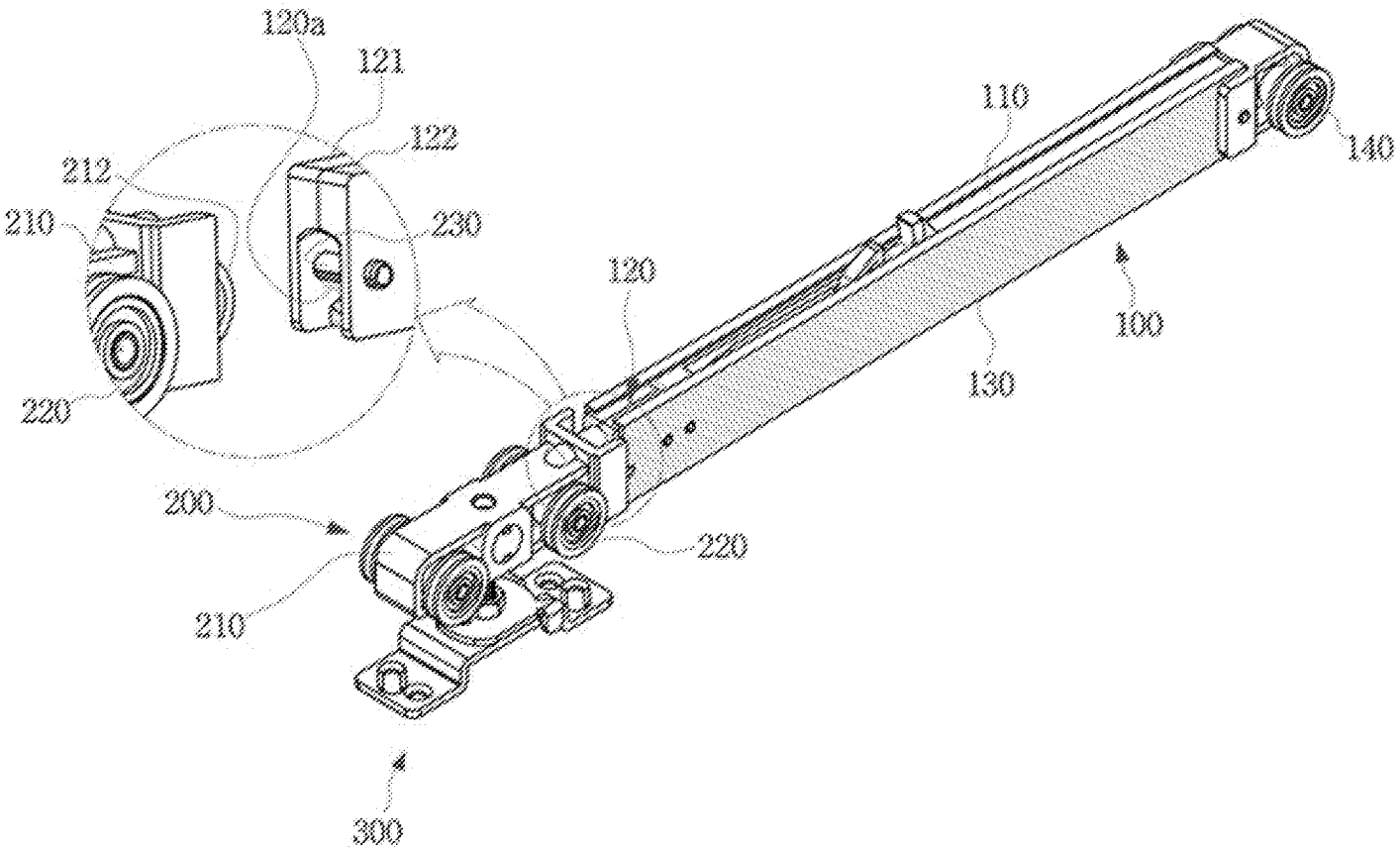
FIGS. 1 to 3 are partially enlarged views and perspective views illustrating a multi-directional rotational sliding door self-closing device according to the present invention.
Figure 2:
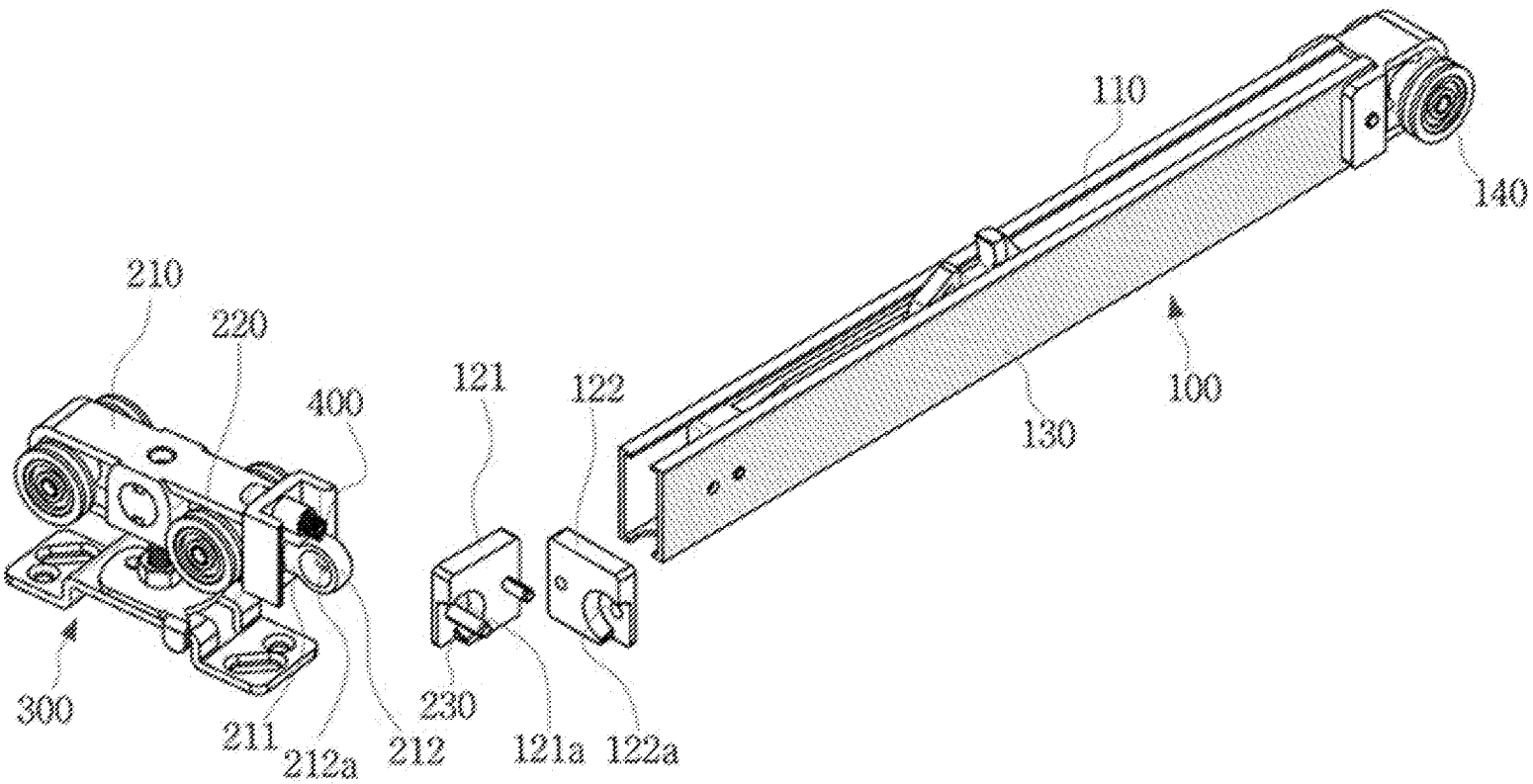
Figure 3:
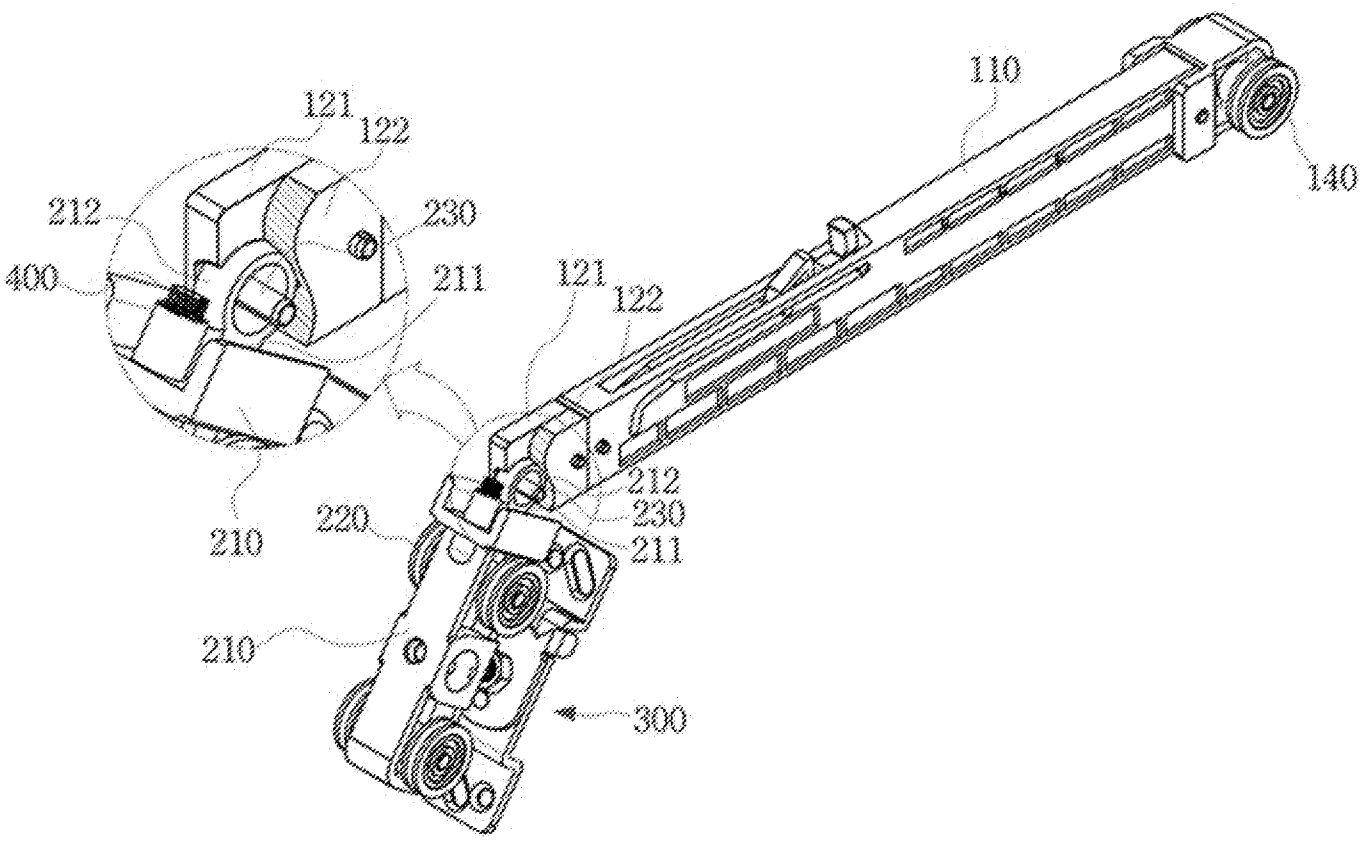
Figure 4:
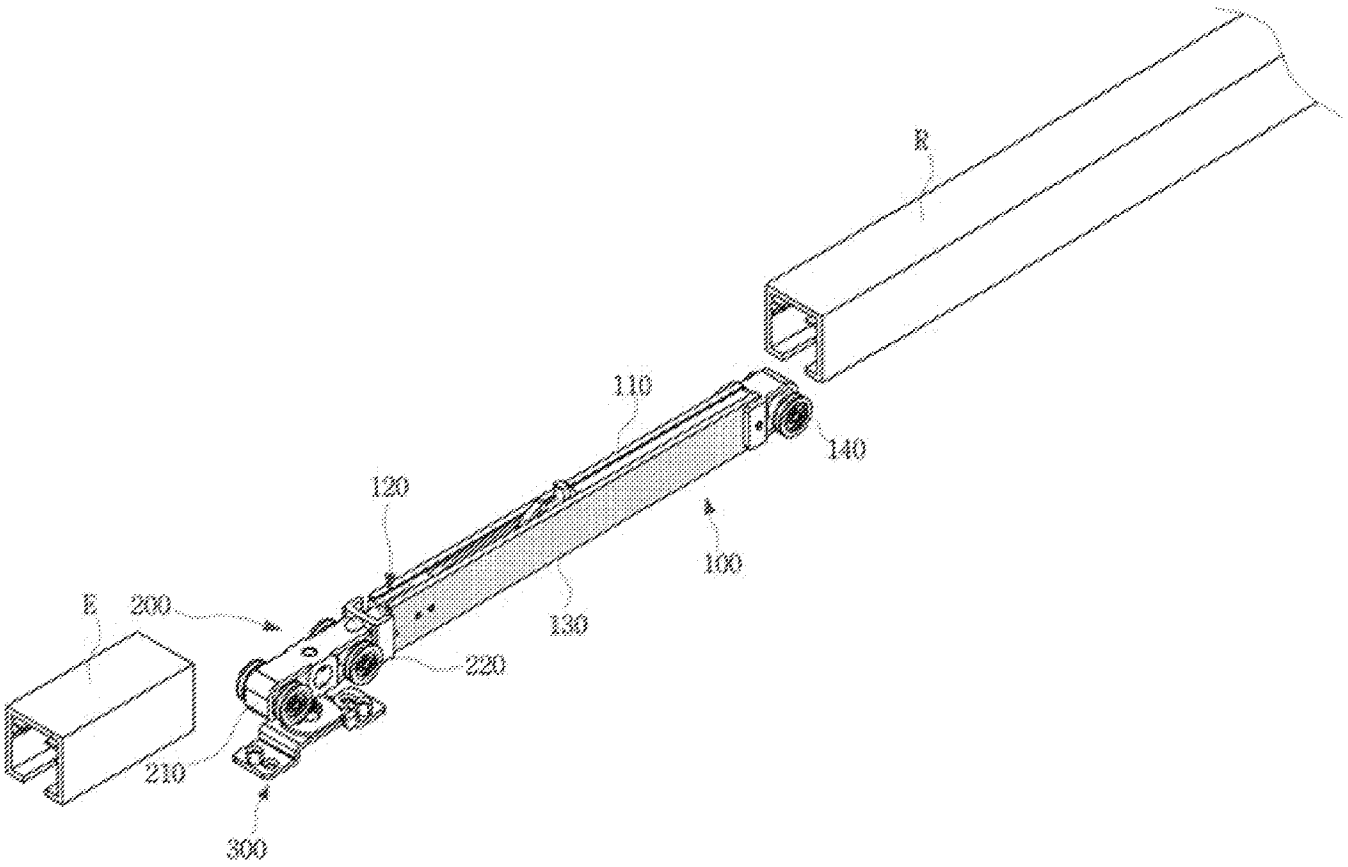
FIG. 4 is an exploded perspective view illustrating a rail and an extension rail of the multi-directional rotational sliding door self-closing device according to the present invention.
Figure 5A:
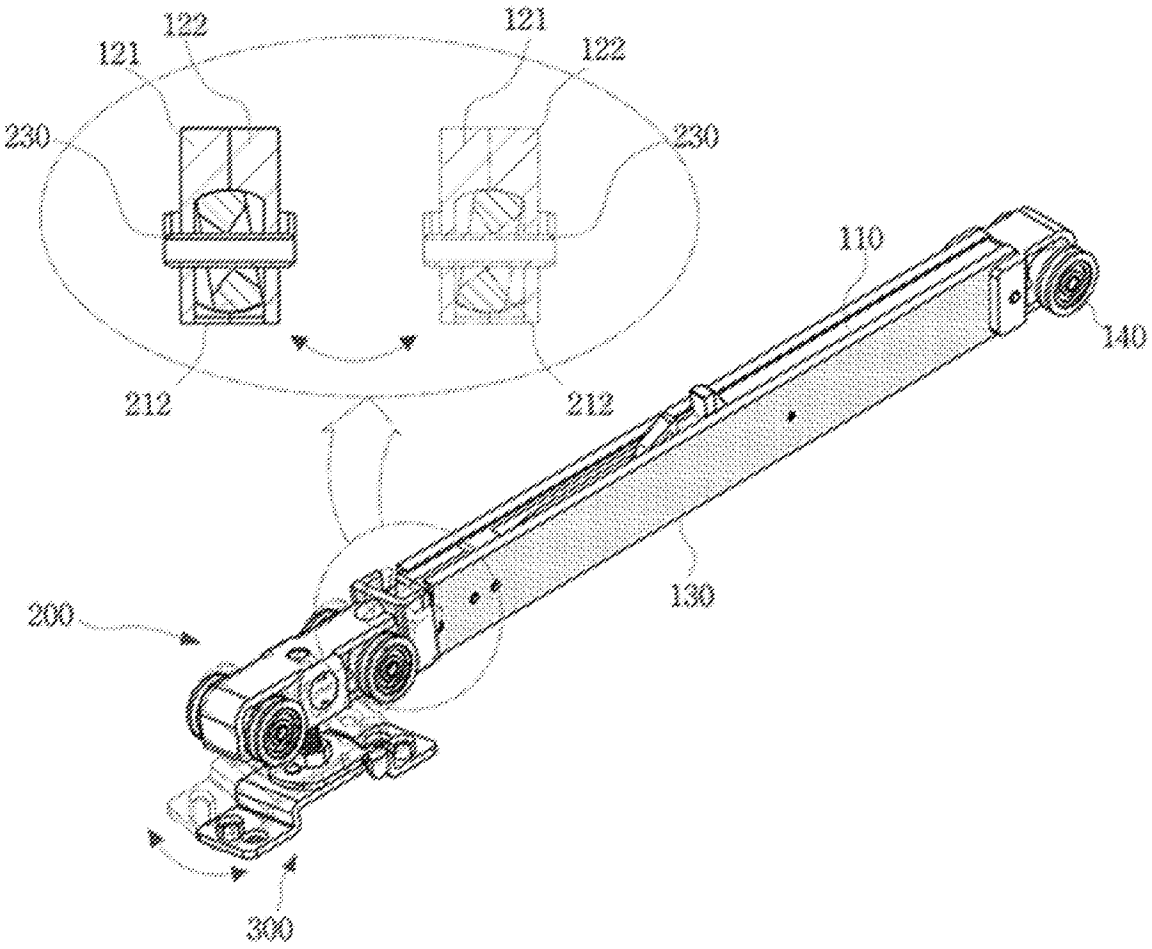
FIGS. 5A to 5C are partially enlarged views illustrating rotation of the multi-directional rotational sliding door self-closing device according to the present invention.
Figure 5B:
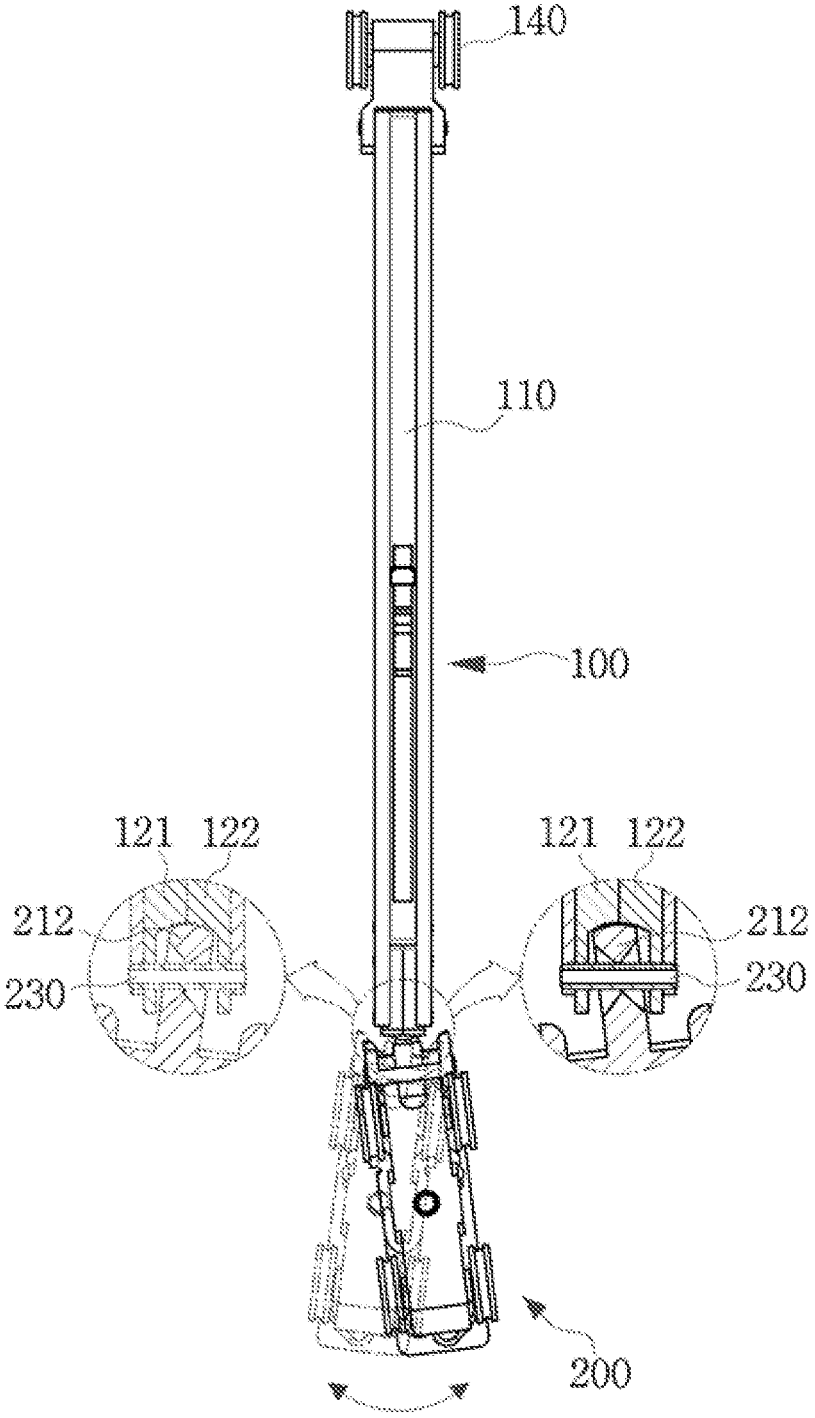
Figure 5C:
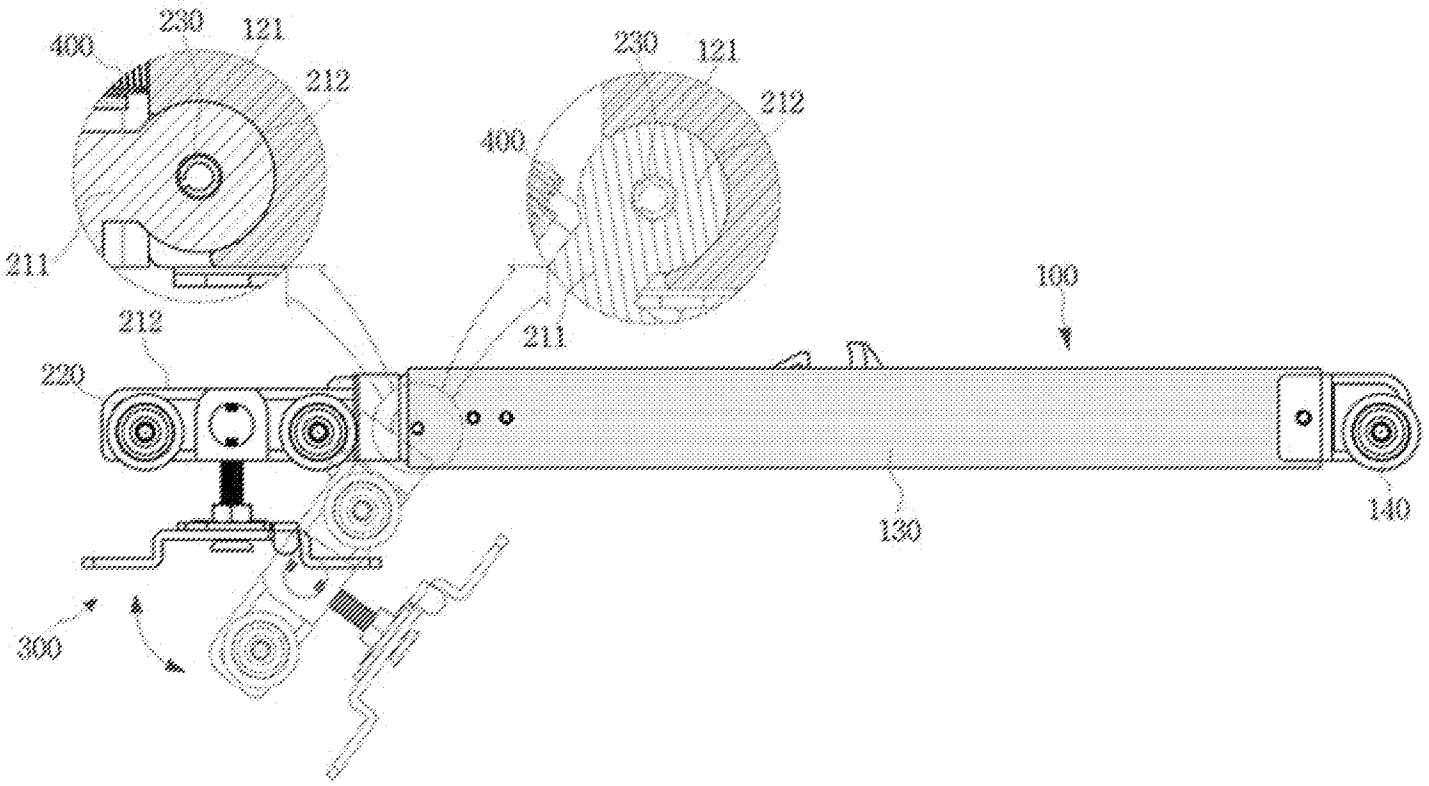

FIGS. 1 to 3 are partially enlarged views and perspective views illustrating a multi-directional rotational sliding door self-closing device according to the present invention. FIG. 4 is an exploded perspective view illustrating a rail and an extension rail of the multi-directional rotational sliding door self-closing device according to the present invention. FIGS. 5A to 5C are partially enlarged views illustrating rotation of the multi-directional rotational sliding door self-closing device according to the present invention.

Figure 6:
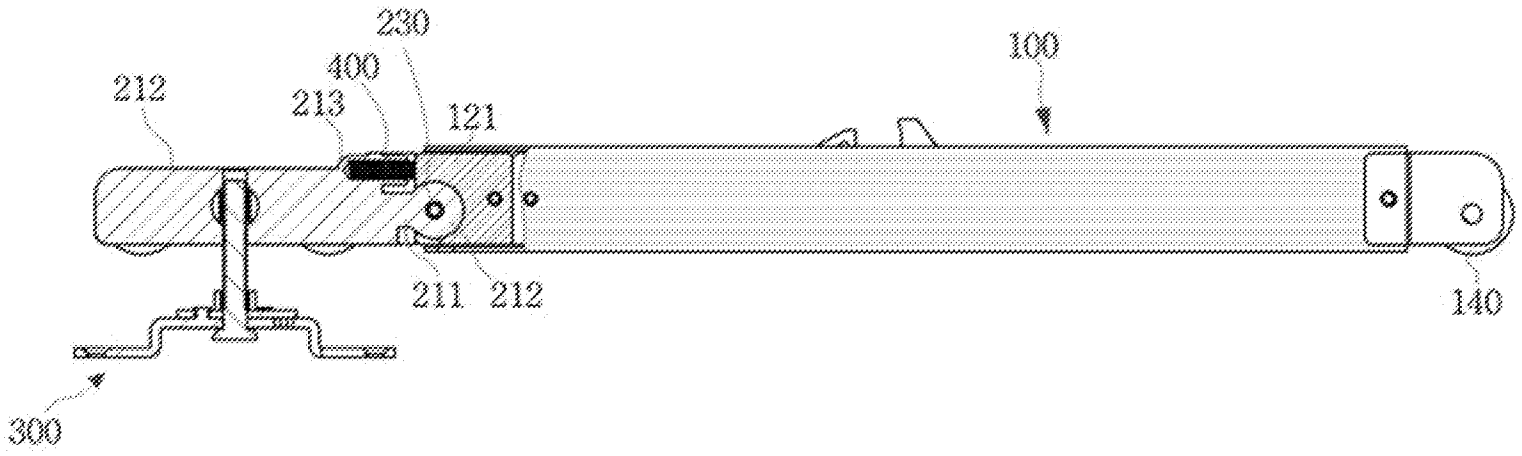
FIG. 6 is a cross-sectional view illustrating the multi-directional rotational sliding door self-closing device according to the present invention.
Figure 7A:
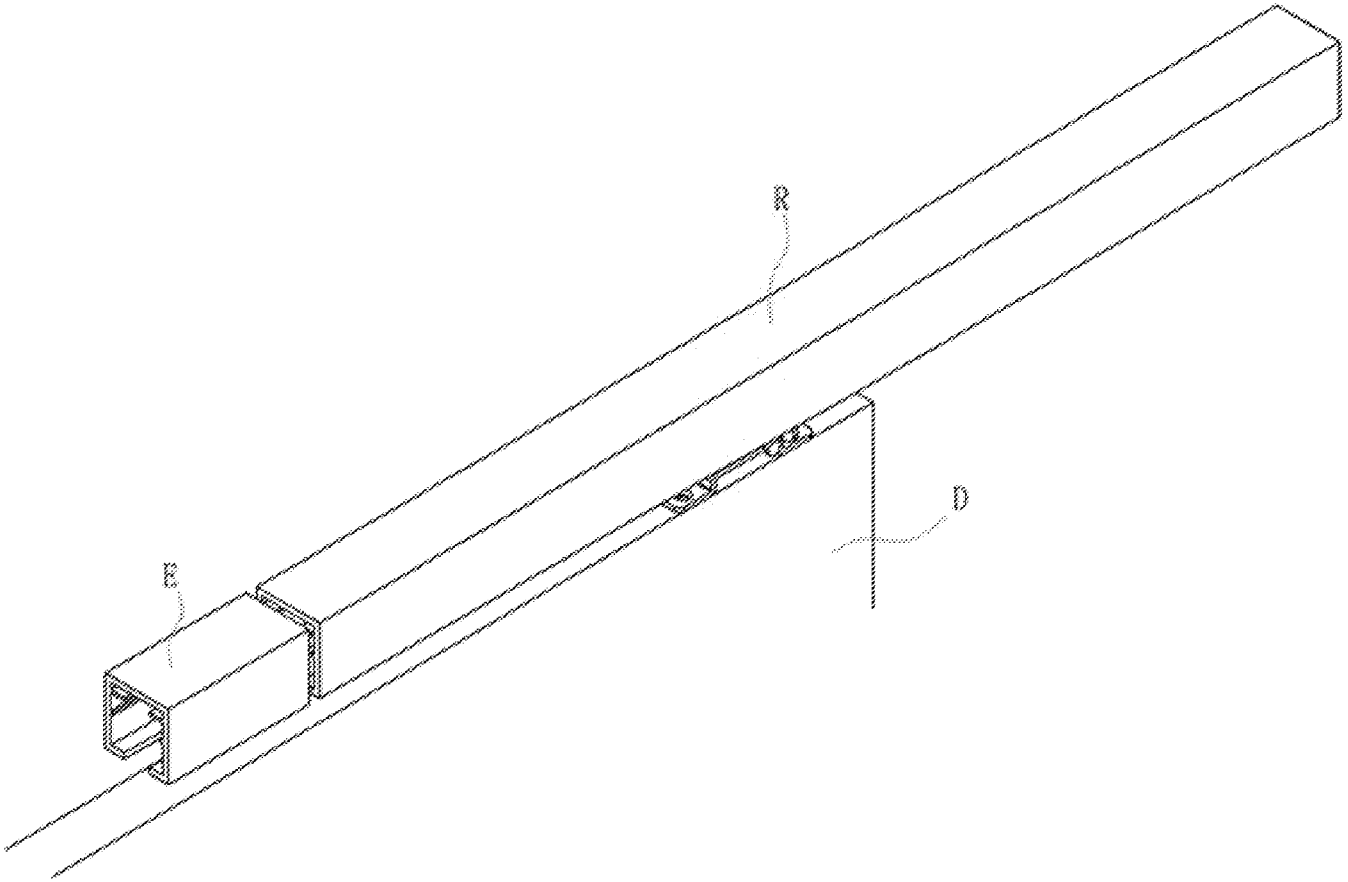
FIGS. 7A and 7B are perspective views illustrating how the multi-directional rotational sliding door self-closing device according to the present invention is installed in the rail.
Figure 7B:
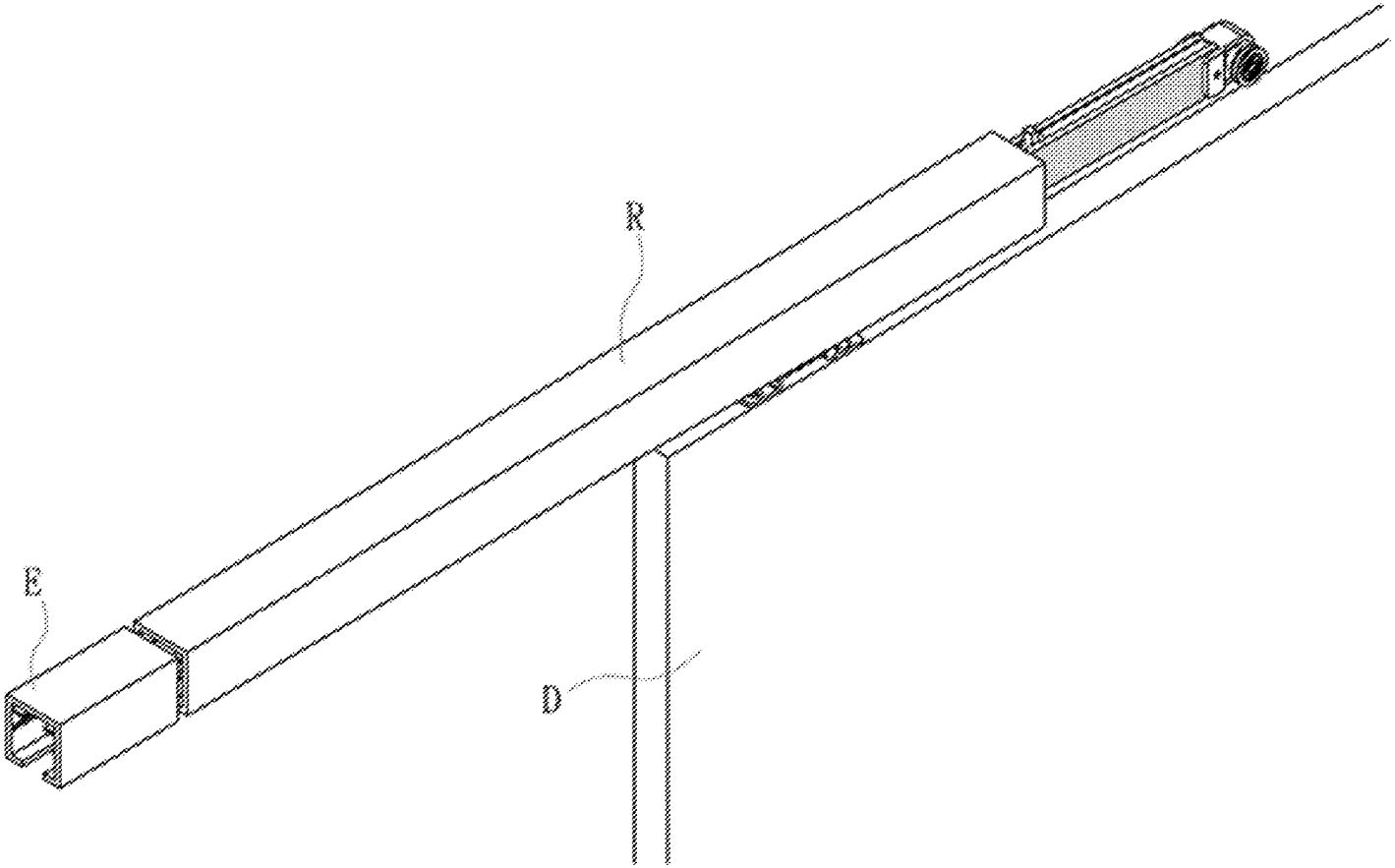
Figure 8:
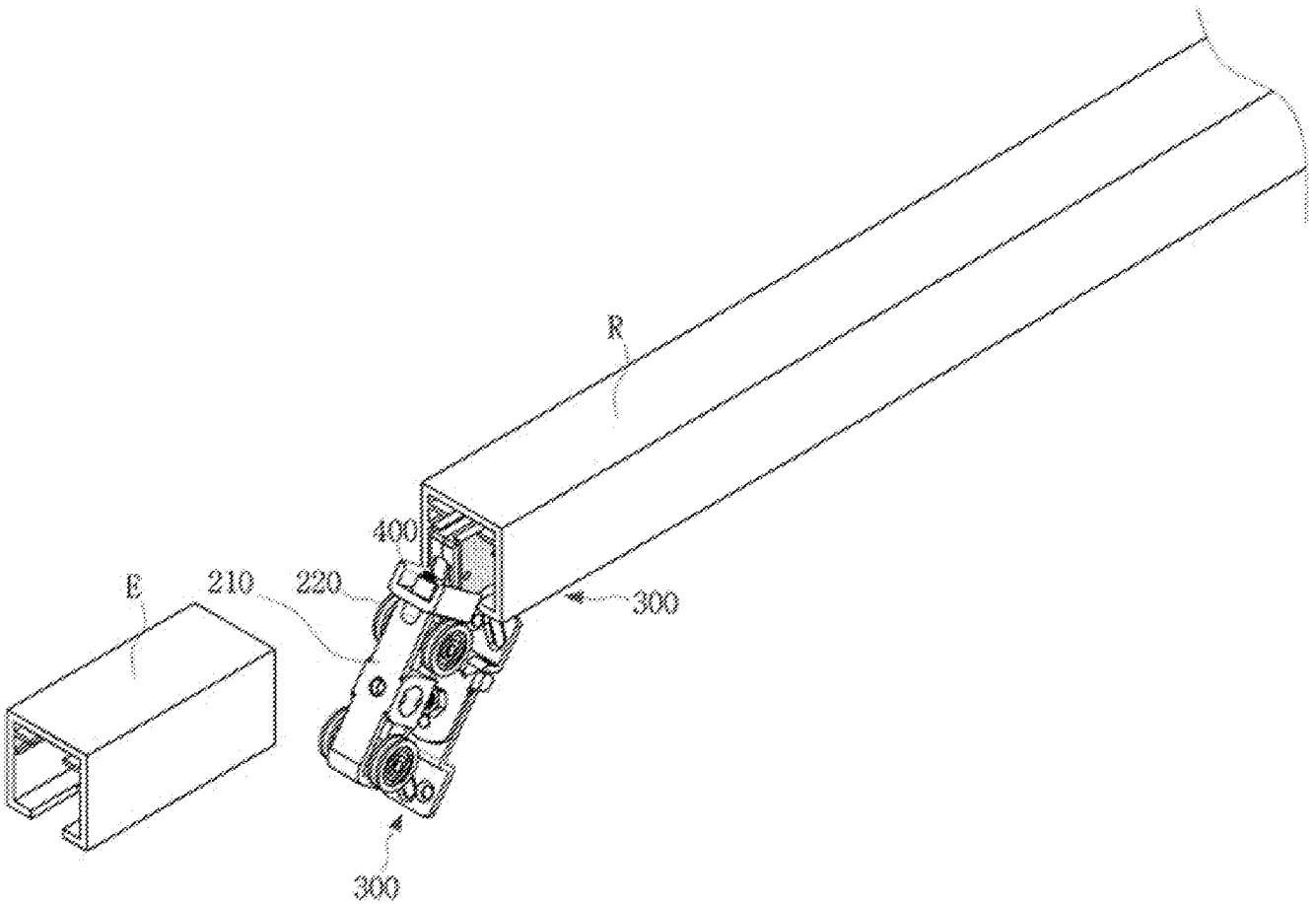
FIG. 8 is a perspective view illustrating how the multi-directional rotational sliding door self-closing device according to the present invention is removed from the rail.

FIG. 6 is a cross-sectional view illustrating the multi-directional rotational sliding door self-closing device according to the present invention. FIGS. 7A and 7B are perspective views illustrating how the multi-directional rotational sliding door self-closing device according to the present invention is installed in the rail. FIG. 8 is a perspective view illustrating how the multi-directional rotational sliding door self-closing device according to the present invention is removed from the rail.

The multi-directional rotational sliding door self-closing device according to the present invention is a device for automatically closing a door D sliding along a rail R straightly aligned with an extension rail E.

The multi-directional rotational sliding door self-closing device includes a damper 100, a roller assembly 200 multi-directionally rotatably connected to a front end of the damper 100, a roller bracket 300 connected to the roller assembly 200, and a coil spring 400 provided in the roller assembly 200.

The damper 100 is operated to automatically and perfectly close the door D at the door closing end of the rail D. In addition, the damper 100 is operated to smoothen a closing speed of the door D.

The damper 100 is provided with a roller 140 at its rear end to allow sliding along the rail R and a connector receptacle cavity 120*a* at its front end.

More specifically, the damper 100 includes a body 110, a block 120 provided at a front end of the body 110, a metal casing 130 provided on outer side surfaces of the body 110 and the block 120, and a roller 140 provided in a rear end of the metal casing 130.

The body 110 is internally provided with a cylinder or spring (not shown), a switch, or the like to smoothen the closing speed while perfectly closing the door D. These components such as the cylinder or spring are well known in the art, and will not be described in detail herein for simplicity purposes.

The block 120 is fabricated in a hexahedral shape and is disposed at the front end of the body 110. In addition, the block 120 has the connector receptacle cavity 120*a* at its front end as described above. More specifically, the block 120 includes a first block 121 and a second block 122 assembled with the first block 121 in a surface contact manner.

The first block 121 has a first circular recess 121*a* on its one surface. The second block 122 has a second circular recess 122*a* on its one surface. The second circular recess 122*a* and the first circular recess 121*a* are combined with each other to form the connector receptacle cavity 120*a*.

Meanwhile, if the block 120 and the roller assembly 200 are connected to each other to form a single module, this module can be applied to another damper 100. This can improve versatility.

The metal casing 130 is provided on outer side surfaces of the body 110 and the block 120 to fix the body 110 and the block 120. The metal casing 130 is formed of, for example, an aluminum-based material to reinforce the body 110. If the self-closing device is used for a long time, the body 110 formed of a plastic material may be stressed for a long time. In some cases, the body 110 may be fractured on its side surface due to such a stress. In order to reinforce the body 110, the body 110 is fixed to the metal casing 130 on its both side surfaces.

A pair of rollers 140 are provided in both sides of the rear end of the metal casing 130 to allow sliding along the rail R.

The roller assembly 200 guides the door D when the door D is opened or closed. The roller assembly 200 is multi-directionally rotatably connected to the front end of the damper 100 and moves along the rail R. The roller assembly 200 is provided with a support 211 at its rear end, and a ring connector 212 is provided at a tip of the support 211.

More specifically, the roller assembly 200 includes a roller body 210 and at least four rollers 220 mounted to both sides of front and rear ends. The roller body 210 is provided with the support 2111 at its rear end, and the ring connector 212 is provided at the tip of the support 211.

The support 211 is integrally formed at the rear end of the roller assembly 200, that is, at the rear end of the roller body 210 to horizontally extend toward the block 120. The ring connector 212 is integrally formed at the tip of the support 211 in a ring shape having a through-hole 212*a* in its center.

The through-hole 212*a* does not have a constant diameter. Instead, the diameter of the through-hole 212*a* decreases and then increases from one side to the other side. That is, the through-hole 212*a* is formed in a rounded shape such that its diameter is minimized in the center, and the through-hole 212*a* horizontally penetrates through the ring connector 212.

Meanwhile, the fixing pin 230 is provided to penetrate through the through-hole 212*a* of the ring connector 212 shaped as described above and a portion of the damper 100 where the connector receptacle cavity 120*a* is provided. The fixing pin 230 locks the roller assembly 200 to the block 120 and serves as a center of rotation when the roller assembly 200 is rotated with respect to the damper 100.

That is, the roller assembly 200 is allowed to vertically and horizontally rotate with respect to the fixing pin 230. In addition, the roller assembly 200 is allowed to rotate with respect to the fixing pin 230 in any direction in addition to the horizontal and vertical directions. A rotatable range in an arbitrary direction other than the horizontal and vertical directions is determined by a distance between the fixing pin 230 and a surface of the through-hole 212*a*.

In other words, if the roller assembly 200 is twisted, the ring connector 212 rotates inside the connector receptacle cavity 120*a*. In the middle of this rotation, a surface of the through-hole 212*a* comes into contact with the fixing pin 230 inside the connector receptacle cavity 120*a*. As a result, the ring connector 212 is not rotatable any more in that direction. That is, the fixing pin 230 serves as a stopper for restricting a rotation angle of the ring connector 212.

In this structure, the ring connector 212 is inserted into the connector receptacle cavity 120*a* and rotates in multiple directions. As a result, the roller assembly 200 can be multi-directionally rotated or bent with respect to the damper 100.

The lower side of the connector receptacle cavity 120*a* is opened. Therefore, the support 211 can be inserted into the opened lower side of the connector receptacle cavity 120*a* by rotating the roller assembly 200 downward with respect to the damper 100.

Since the lower side of the connector receptacle cavity 120*a* is opened as described above, the ring connector 212 has a vertical rotation angle larger than rotation angles of other directions (including the horizontal direction or any direction other than the horizontal and vertical directions).

The roller bracket 300 is connected to a lower side of the roller body 210 of the roller assembly 200 and is fixed to an upper end of the door D. Specifically, the roller bracket 300 is connected to the door D outside the rail R and is also connected to the roller body 210. In addition, the rollers 220 of the roller assembly 200 are placed inside the rail R such that the door D is movably supported.

The coil spring 400 is installed in the roller assembly 200. An insertion hole 213 is formed at the rear end of the roller body 210 of the roller assembly 200. The coil spring 400 is inserted into the insertion hole 213.

The damper 100 and the roller assembly 200 are rotatable with respect to each other as described above. When the damper 100 and the roller assembly 200 are straightly aligned with each other during this rotation, the coil spring 400 abuts on the tip of the damper 100. That is, the coil spring 400 abuts on the leading end surface of the block 120.

The multi-directional rotational sliding door self-closing device according to the present invention will now be described in more detail. The extension rail E is placed in a door opening start position in the door opening direction such that the rail R is straightly aligned with the extension rail E. The self-closing device obtained by assembling the damper 100, the roller assembly 200, the roller bracket 300, and the coil spring 400 is installed in an upper end of the door D and is then inserted into the rail R.

If the rail R is deformed by an external force in this state, it is difficult to appropriately drive the damper 100 and the roller assembly 200 sliding along the rail R only by a rectilinear motion.

According to the present invention, the ring connector 212 of the roller assembly 200 is rotated in response to deformation of the rail R inside the connector receptacle cavity 120*a*. Therefore, the roller assembly 200 is horizontally or vertically rotated at a certain angle with respect to the damper 100. In other words, the roller assembly 200 is rotated at a certain angle about the fixing pin 230 so that the door D can be appropriately driven even along the deformed rail D.

In this manner, the self-closing device according to the present invention is appropriately driven even along the deformed rail R by virtue of a motion of the ring connector 212 rotated inside the connector receptacle cavity 120*a*.

Meanwhile, in order to check the damper 100 or the roller assembly 200 installed inside the rail R for maintenance or inspection purposes, it is necessary to remove the extension rail E and then remove the damper 100 or the roller assembly 200 from the rail R.

However, it is difficult to remove the damper 100 and the roller assembly 200 from the rail R because the extension rail E typically has a length of 10 cm, and a total length of the damper 100 and the roller assembly 200 is typically much longer than that of the extension rail E. For this reason, according to the present invention, the damper 100 and the roller assembly 200 are rotatably connected. Since the damper 100 and the roller assembly 200 are not fixed to each other, the coil spring 400 is provided to evenly transmit a force to the damper 100 and the roller assembly 200. In this configuration according to the present invention, it is possible to easily remove the damper 100 and the roller assembly 200 from the rail R by rotating the damper 100 and the roller assembly 200 in a space formed by removing the extension rail E.

In the multi-directional rotational sliding door self-closing device according to the present invention, the damper and the roller assembly are connected to each other in a multi-directional rotational manner. Therefore, it is possible to appropriately drive the damper and the roller assembly on the rail even when the rail is deformed. In addition, it is possible to easily remove the damper and the roller assembly through a short space of the extension rail.

Specifically, since the ring connector is rotated inside the connector receptacle cavity, it is possible to rotate the roller assembly horizontally and vertically with respect to the roller assembly. In addition, it is possible to rotate the roller assembly in various directions such as clockwise or counterclockwise. Therefore, it is possible to appropriately drive the damper and the roller assembly regardless of the rail is deformed in any shape.

An elastic force of the coil spring is evenly transmitted to the damper and the roller assembly when the damper and the roller assembly are straightly aligned. Therefore, the rollers of the damper and the rollers of the roller assembly appropriately abut on the rail. Accordingly, it is possible to facilitate sliding of the door.

Although exemplary embodiments of the present invention have been shown and described hereinbefore, it will be apparent to those having ordinary skill in the art that a number of changes, modifications, or alterations to the invention as described herein may be made, none of which depart from the spirit of the present invention. All such changes, modifications and alterations should therefore be seen as within the scope of the present invention.

What is claimed is:

1. A self-closing device configured to automatically close a door moving along a rail straightly aligned with an extension rail, comprising:

a damper provided with a roller at its rear end and configured to move along the rail to automatically close the door;

a roller assembly multi-directionally rotatably connected to a front end of the damper and configured to move along the rail; and a roller bracket connected to the roller assembly and fixed to an upper end of the door, wherein the roller assembly comprises a support protruding from its rear end and a ring connector formed at a tip of the support and provided with a through-hole, wherein the damper comprises a connector receptacle cavity formed at its front end where the ring connector is inserted and is rotated in multiple directions, wherein a fixing pin penetrates through a portion of the connector receptacle cavity of the damper and the through-hole of the ring connector, and wherein the diameter of the through-hole is narrowest in the center of the through-hole and progressively increases towards the sides.

2. The multi-directional rotational sliding door self-closing device according to claim 1, wherein a lower side of the connector receptacle cavity is open, and the support is inserted into the opened lower side of the connector receptacle cavity when the roller assembly is rotated downward with respect to the damper.

3. The multi-directional rotational sliding door self-closing device according to claim 1, wherein the damper comprises:

a body, a block disposed at a front end of the body and provided with the connector receptacle cavity at its front end, a metal casing provided on outer side surfaces of the body and the block in a manner that fixes the body and the block, and the roller provided at a rear end of the metal casing.

4. The multi-directional rotational sliding door self-closing device according to claim 3, wherein the block comprises:

a first block provided with a first circular recess, and a second block assembled with the first block and provided with a second circular recess combined with the first circular recess to form the connector receptacle cavity.

5. The multi-directional rotational sliding door self-closing device according to claim 1, further comprising a coil spring abutting on a tip of the damper when the damper and the roller assembly are straightly aligned, wherein the roller assembly comprises an insertion hole, and the coil spring inserted into the insertion hole.

* * * * *